US005419526A

United States Patent [19]

Chieng

[11] Patent Number: 5,419,526

[45] Date of Patent: May 30, 1995

[54] PORTABLE READING HOLDING FOR KEY-IN DOCUMENT

[76] Inventor: Walter Chieng, 1F, No. 12, Alley 18, Lane 277, Sec. 6 Chung Shan N. Rd., Taipei, Taiwan, Prov. of China

[21] Appl. No.: 119,723

[22] Filed: Sep. 10, 1993

[51] Int. Cl.[6] ..... A47B 97/04

[52] U.S. Cl. ..... 248/447; 248/441.1; 248/460; 248/461

[58] Field of Search ..... 248/441.1, 447, 454, 248/457, 460, 461, 152; 40/124; D19/86, 91; D6/310; 108/33

[56] References Cited

U.S. PATENT DOCUMENTS 502,991 8/1893 Phillips ..... 248/454
1,051,047 1/1913 Wood ..... 248/447
3,833,197 9/1974 Dyke ..... 248/441
4,998,703 3/1991 Stewart ..... 248/447

*Primary Examiner*—Leslie A. Braun
*Assistant Examiner*—Catherine S. Collins
*Attorney, Agent, or Firm*—Notaro & Michalos

[57] ABSTRACT

A portable reading holder which has a loading frame, a base and a dust-proof cover. The loading frame has fixing ears formed at its lower end, which can be fixed on pivot seats of the base plate and can be rotated freely so as to regulate the angle. The best viewing angle when keying in data or a document laid on the reading holder is thus obtained. The portable reading holder is small and can be carried or repositioned conveniently.

4 Claims, 3 Drawing Sheets

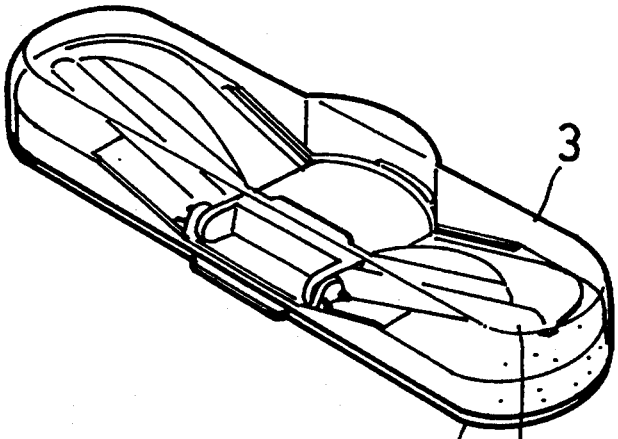
FIG. 2
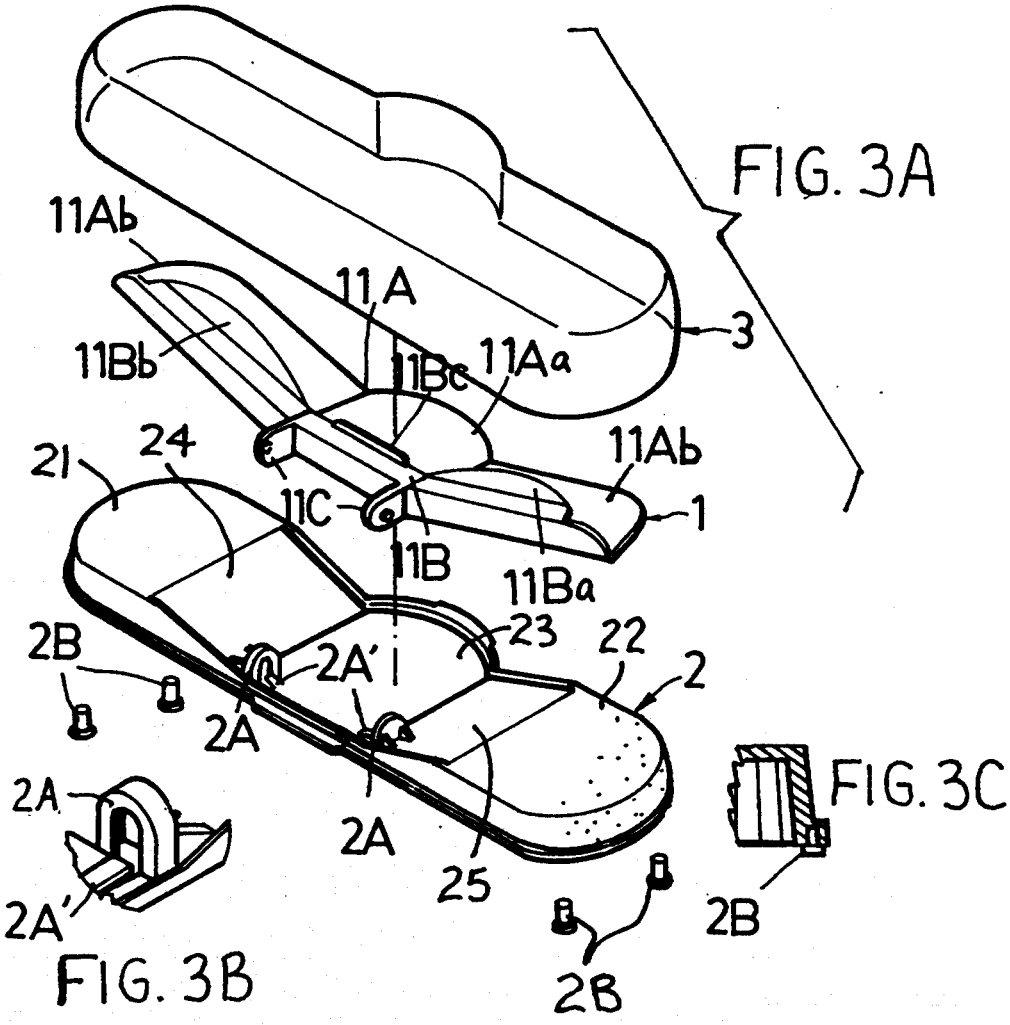

PORTABLE READING HOLDING FOR KEY-IN DOCUMENT

BACKGROUND OF THE INVENTION

This invention relates to a portable reading holder for key-in documents, especially a reading holder which can be operated to regulate its angle so as to get the best viewing angle.

As is well known, the computer industry has been developed widely in recent years, and there are a lot of documents that can be processed efficiently by using a typewriter or computer to save data, but when processing these documents, users may face some problems, such as how to position these papers appropriately so as to get the best viewing angle and how to raise working efficiency etc.

There are many kinds of reading holders on the present market, but these conventional reading holders always have some common defaults; (1) They must be operated by two hands at the same time. (2) They occupy too much space. (3) They are inconvenient for users to carry or operate. FIGS. 1A to 1D show the reading holders (100) and (200) with an adjustable arm and the desk-top reading holders (300) and (400).

SUMMARY OF THE INVENTION

It is therefore the main object of this invention to provide a portable reading holder which is composed of a loading frame, a base and a dust-proof cover, the section of the loading frame being formed into "J" shape and its lower part having a fixing ball which can be fixed on a pivot seat of the base and can be rotated freely so as to regulate the loading frame and get the best viewing angle.

BRIEF DESCRIPTION OF THE DRAWINGS

For purpose of promoting an understanding of the principles of this invention, reference will be made to the embodiment illustrated in the drawings:

FIG. 2 is a perspective view of this invention.

FIG. 3A is an exploded view of this invention.

FIG. 3B is a detail of part of the invention shown in FIG. 3A.

FIG. 3C is another detail of the invention of FIG. 3A.

DETAILED DESCRIPTION OF THE PREFERRED EMBODIMENT

Figure 1A:
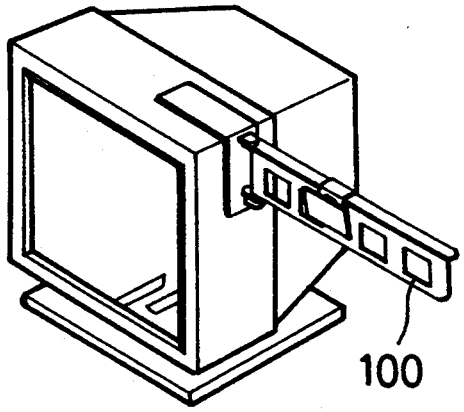
FIG. 1A (PRIOR ART)
FIG. 1A is a perspective view showing the outline of the conventional reading holder.
Figure 1B:
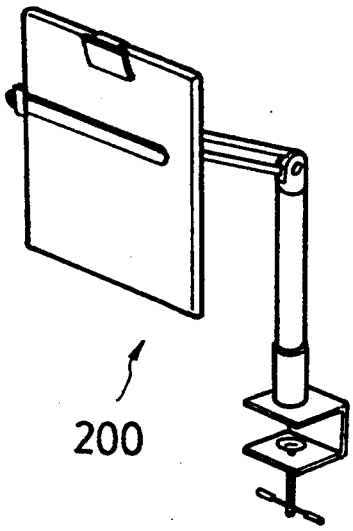
FIG. 1B (PRIOR ART)
FIG. 1B is a view similar to FIG. 1A of another conventional reading holder.
Figure 1C:
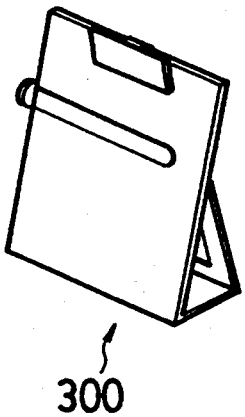
FIG. 1C (PRIOR ART)
FIG. 1C is a view similar to FIG. 1A of a still further conventional reading holder.
Figure 1D:
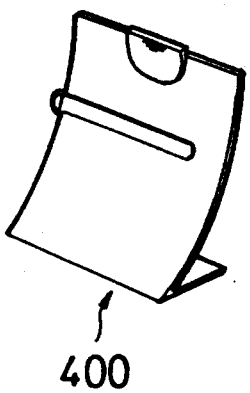
FIG. 1D (PRIOR ART)
FIG. 1D is a view similar to FIG. 1 of a still further conventional reading holder.
Figure 4:
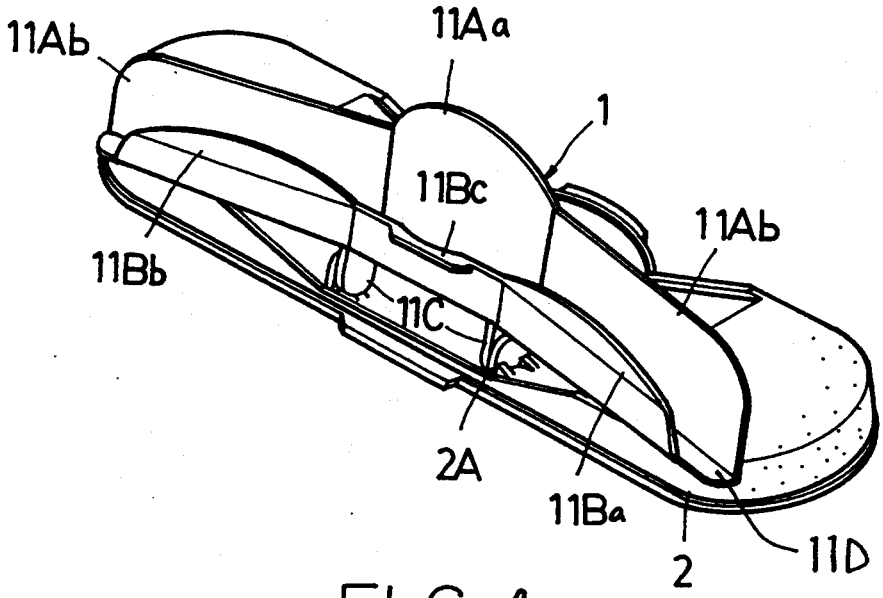
FIG. 4 is a perspective view of this invention, (not including dust-proof cover).

Referring to FIG. 2 to FIG. 4, the portable reading holder of the present invention is composed of a loading frame (1), a base (2) and a dust-proof cover (3), wherein the loading frame (1) is formed to have "J" shape cross-section, its rear wall (11A) being taller than the front wall, the flat left part (11Ab) and the flat right part (11Ab) of the loading frame (1) are even and extending to its flat center part (11A) at an angle of about 20 degrees to form into an arc shape, just like "∧" shape, the front part of the loading frame having a stop plate (11B) and two arc guide plates (11Ba) (11Bb); the center of the stop plate having a forwardly projecting flange (11Bc), furthermore the lower part of the loading frame (1) having a pair of fixing ears with side protections (11C). The base (2) has an elliptic shape, two raised sides 21 and 22 of the bottom of the base (2) being hollow and the lower left center 23 being formed into an arc concave rear shape. Inclined areas 24, 25 connect center 23 to sides 21, 22. The front end of the base having a pair of pivot seats (2A) in which is provided an elastic piece (2A') respectively so as to fix the fixing ears (11C) and allow the loading frame to rotate around the pivot seats (2A) to regulate its angle. The bottom of the base (2) has four legs with cushion pads (2B). The dust-proof cover (3) is made of transparent material, and forms a dome with an outline that matches and encloses the loading frame (1) and the base (2).

Figure 5A:
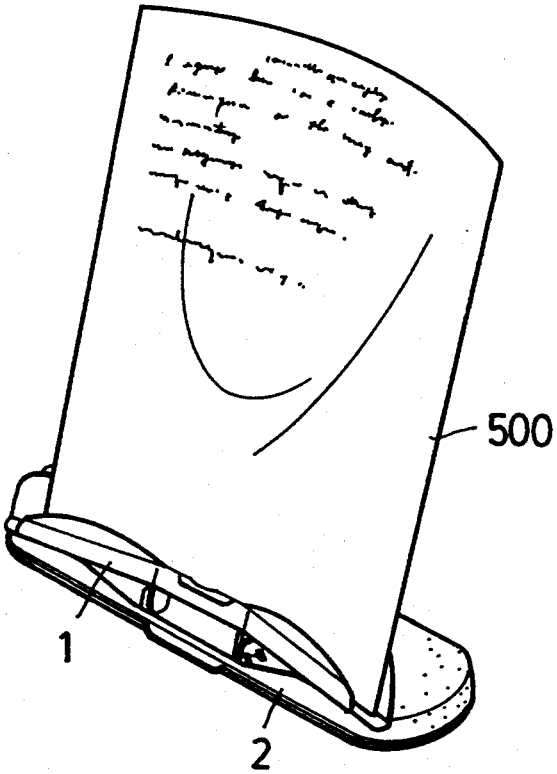
FIG. 5A and FIG. 5B are the perspective views showing the preferred embodiments of this invention.
Figure 5B:
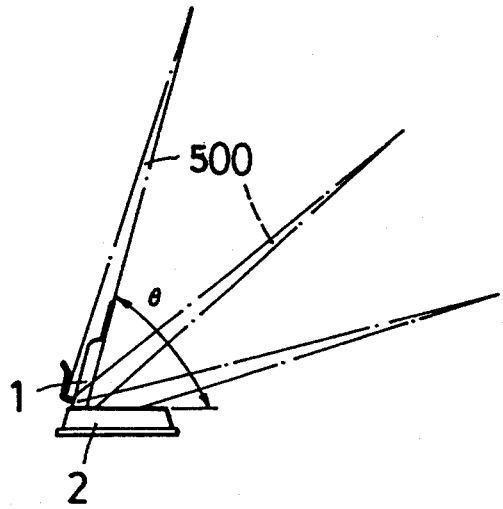

Referring to FIG. 5A and FIG. 5B, when using the portable reading holder, the operator can regulate the loading frame to the best viewing angle and can put the document (500) in place with one hand. The arc shaped guide plates (11Ba) (11Bb) can lead the document (500) into the loading frame (1) properly, when putting papers on the loading frame (1), these papers being arc shape, owing to the binding force applied to the paper, thus these papers laid on the loading frame (1) will not fall down, therefore the portable reading holder Being suitable for positioning key-in documents. Loading frame (1) can be rotated around the pivot seats (2A) so as to provide the best viewing angle. Returning to FIG. 4, the J-shaped cross-section of the trough of frame 1, is formed by the tall rearwall 11A, the stop plate or front wall 11B, and a flat bottom wall 11D, together forming the one piece frame 1. As previously mentioned, the center 11Aa, has an arc shaped top which extends above the top edges of the side parts 11Ab, which themselves have curved corners. The guide plates 11Ba and 11Bb have arc upper edges which are taller than the forwardly projecting flange 11Bc, with the entire front wall 11B being narrowing than the bottom wall 11D, which has a curved corner between the front and rear walls.

It is understood by those skilled in the art that the foregoing description is a preferred embodiment of the disclosed device and that various changes and modifications may be made in the invention without departing from the spirit and scope thereof.

What is claimed is:

1. A portable holder for holding a paper to be viewed for key-in data entry and typing comprising:

a base which is elliptical in top plan view and has two hollow raised sides and a flat center connecting the raised sides by inclined areas and forming a lower central portion, the center having a concave rear arc at a rear side thereof, a pair of spaced apart pivot seats at a front of the center, and an elastic piece adjacent each pivot seat;

a frame having a rear wall, a front wall, and a bottom wall, the bottom wall connected between said rear wall and said front wall defining a bent trough having a J-shaped cross-section, the rear wall having a flat center part with an upper arc and a pair of flat side parts extending at an angle to the flat center part on opposite sides of the flat center part, the front wall having a center part spaced apart from the center part of the rear wall, the center part of the front wall having an upper edge with a forwardly projecting flange and flat guide plates extending at an angle to and on opposite sides of the center part of the front wall, each of the guide plates being spaced apart from a respective one of the side parts and having an arc at an upper edge thereof extending above the center part of the front wall, the rear wall being taller than the front wall at all locations, and the trough being for receiving a paper which bends to fit in the trough and thus remains upright;

a pair of ears with projections extending downwardly from the flat bottom wall of the frame and adjacent the center parts of the rear and front walls, each ear for engagement into one of the pivot seats with the elastic pieces engaged against the respective ears for allowing pivoting of the frame with respect to the base and maintaining a selected angle between the frame and the base; and a dome-like transparent dust-proof cover for engaging and covering the frame and base when the frame is pivoted to a lower position with the center part of the frame against the flat center of the base.

2. A holder according to claim 1 wherein each of the side parts of the rear wall have curved corners, the front wall being narrower than the rear wall and the flat bottom wall having curved corners between the front and rear walls.

3. A holder according to claim 2 wherein the arc at the top of the center part of the rear wall matches the shape of the concave rear arc in the base, the dust-proof cover including an arc area for receiving the rear arc of the base.

4. A holder according to claim 1 wherein the arc at the top of the center part of the rear wall matches the shape of the concave rear arc in the base, the dust-proof cover including an arc area for receiving the rear arc of the base.

* * * * *